US006805031B1

(12) United States Patent
Stallato

(10) Patent No.: US 6,805,031 B1
(45) Date of Patent: Oct. 19, 2004

(54) FINGER SHIELD FOR SLICING VEGETABLES

(76) Inventor: Mark Stallato, 209 Springmeadow Rd., unit N, Holbrook, NY (US) 11741

( * ) Notice: Subject to any disclaimer, the term of this patent is extended or adjusted under 35 U.S.C. 154(b) by 0 days.

(21) Appl. No.: 10/436,399

(22) Filed: May 12, 2003

(51) Int. Cl.[7] ..... B26D 7/02
(52) U.S. Cl. ..... 83/452; 83/762; 83/932
(58) Field of Search ..... D7/672, 673, 674, D7/683, 686; 83/451, 454, 455, 452, 761, 762, 763, 932, 459, 732, 765

(56) References Cited

U.S. PATENT DOCUMENTS

| | | | | | |
|---|---|---|---|---|---|
| 941,798 | A | | 11/1909 | Moore | |
| 1,605,770 | A | * | 11/1926 | Potter | 83/762 |
| 1,703,154 | A | | 2/1929 | Lanzkron | |
| 2,219,413 | A | | 10/1940 | Dellar | |
| 2,244,072 | A | | 6/1941 | Ledbetter | |
| 2,881,022 | A | | 4/1959 | Brust | |
| 3,181,198 | A | | 5/1965 | Stelzen | |
| 3,975,043 | A | | 8/1976 | Miles | |
| 4,131,043 | A | * | 12/1978 | Colman et al. | 83/167 |
| 4,310,971 | A | | 1/1982 | Rowell | |
| 4,341,376 | A | * | 7/1982 | Germinario | 269/288 |
| 4,507,804 | A | | 4/1985 | Consigny | |
| 5,626,067 | A | | 5/1997 | Lothe | |
| 5,715,736 | A | | 2/1998 | Cherney | |
| 5,927,701 | A | | 7/1999 | Chapman | |
| 6,389,944 | B1 | * | 5/2002 | Davidson | 83/762 |

* cited by examiner

*Primary Examiner*—Stephen Choi
(74) *Attorney, Agent, or Firm*—Michael I. Kroll

(57) ABSTRACT

A finger shield that is placed over elongated vegetables or like food items to provide an effective barrier between a cutting blade and the user's fingers when the user is slicing the foodstuff includes a U-shaped body, a spring-loaded handle, and a compression plate for holding the food item to be cut.

4 Claims, 8 Drawing Sheets

FINGER SHIELD FOR SLICING VEGETABLES

BACKGROUND OF THE INVENTION

1. Field of the Invention

The present invention relates generally to food handling devices and, more specifically, to a finger shield for use by a person slicing elongate foodstuffs such as carrots, celery, beans and the like to protect the user from accidentally cutting their fingers with the knife during preparation. The device comprises a substantially semi-circular body having a flange member extending perpendicularly outward from one edge thereof. A compression element may also be included for stabilizing the vegetable during slicing.

2. Description of the Prior Art

There are other protective devices designed for food handling. Typical of these is U.S. Pat. No. 941,798 issued to W. J. Moore on Nov. 30, 1909.

Another patent was issued to A. Lanzkron on Feb. 26, 1929 as U.S. Pat. No. 1,703,154. Yet another U.S. Pat. No. 2,219,413 was issued to M. R. Dellar on Oct. 29, 1938 and still yet another was issued on Jun. 3, 1941 to W. C. Ledbetter as U.S. Pat. No. 2,244,072.

Another patent was issued to L. P. Brust on Apr. 7, 1959 as U.S. Pat. No. 2,881,022. Yet another U.S. Pat. No. 3,975,043 was issued to L. J. Miles on Aug. 17, 1976. Another was issued to G. D. Rowell on Jan. 19, 1982 as U.S. Pat. No. 4,310,971 and still yet another was issued on Jan. 19, 1982 to C. Consigny as U.S. Pat. No. 4,507,804.

Another patent was issued to A. D. Lothe on May 6, 1997 as U.S. Pat. No. 5,626,067. Yet another U.S. Pat. No. 5,715,736 was issued to R. Cherney on Feb. 10, 1998.

U.S. Pat. No. 1,703,154

Inventor: Anna Lanzkron

Issued: Feb. 26, 1929

A vegetable slicing apparatus comprising relatively adjustable concavo-convex plates, each formed with longitudinally ranging slots, and means carried by the plates to confine the vegetable in a direction at right angles to the plates, said means including end walls carried by the plates and an end wall removably secured in any pair of aligned slots.

U.S. Pat. No. 2,219,413

Inventor: Mose R. Dellar

Issued: Oct. 29, 1940

As a new article of manufacture, a tool comprising a plate portion forming a shield and having opposed flanged retaining jaws offset from one face of the plate portion, a sop associated with one end of said jaws, and a handle supported by said plate solely proximate to the opposite face thereof.

U.S. Pat. No. 2,244,072

Inventor: Wiley C. Ledbetter

Issued: Jun. 3, 1941

An object handling or gripping implement, comprising a pair of elongated substantially rectangular bodies, each of said bodies having a substantially arcuate form longitudinally, means forming a hinge connection between two adjacent end edges of the bodies whereby said bodies lie in side by side relation with the concave sides thereof opposed, means forming gripping teeth along the other edge of each body, said gripping teeth of each body being curved inwardly toward the teeth of the other body, and means carried by each body facilitating the engagement of the fingers and the thumb of a hand in a manner to position the hinge connection between the bodies in the palm of the hand and to facilitate relatively moving the bodies to move the teeth into and out of gripping relation, the said means comprising a strap of flexible material extending transversely of each body upon the side thereof remote from the other body and secured at it's ends to the body across which it extends.

U.S. Pat. No. 2,881,022

Inventor: Leonard P. Brust

Issued: Apr. 7, 1959

A fish gripping device comprising first generally U-shaped and second generally T-shaped arcuately curved sheet metal members with the base of the U-shaped member and the cross-piece of the T-shaped member having adjacent ends hingedly connected together to position concave sides thereof in confronting relation to define an oval opening therebetween, the arms of said U-shaped member providing spaced fingers and the leg of said T-shaped member providing a finger movable between said spaced fingers to grip fish of different sizes between said members and engageable with a stop edge afforded by said U-shaped member at the juncture of said spaced fingers thereof to limit movement of said members toward each other, said fingers and the confronting sides of said having teeth engageable with the fish, and said stop edge on said U-shaped member being generally midway between the hinge connection of said members and the tips of said fingers to provide considerable variations in size of said oval opening during the reception and movement of the finger of the T-shaped member between the spaced fingers of the U-shaped member to capture and securely hold fish between said members and the fingers thereof, said stop member on said U-shaped member being spaced from the hinge connection of said members a predetermined distance substantially the length of the fingers of a hand to prevent engagement of the teeth on the finger of said T-shaped member with the fingers of a hand in engagement with said U-shaped member.

U.S. Pat. No. 3,181,198

Inventor: Fred Stelzen

Issued: May 4, 1965

A hand-held grasping device that is opened and closed by the action of the thumb and forefinger comprising a pair of longitudinally arcuate plate members hinged together at one transverse end with a finger grip provided exteriorly on each plate member, the device being of a size such as to be easily held in the palm of a hand with the thumb and forefinger, each insertable in an adjacent finger grip.

U.S. Pat. No. 3,975,043

Inventor: Leslie John Miles

Issued: Aug. 17, 1976

A gripping device including a pair of side assemblies, each having a substantially constant arcuate cross-sectional configuration throughout its length, projections on its concave inner surface, and free outer edges while their inner edges are hingedly connected together by a hinge to enable said outer edges to be moved towards or away from one another. One said side assembly has along its inner edge a channel and the other is provided with a bead along its inner edge which is pivotally engageable within said channel by relative longitudinal sliding movement therebetween. A torsion-bar spring assembly is disposed adjacent the hinge and connected at its opposite ends into a recess in the respective side assembly and adapted to urge the said side assemblies apart. The parts are so made and arranged that said device may be held within a cupped hand of a user with the outer edges remote from the palm of the hand and disposed substantially parallel to the pivot axis of the user's hand.

U.S. Pat. No. 4,310,971

Inventor: Geoffrey D. Rowell

Issued: Jan. 19, 1982

A hand-held vegetable slicer has a two part molding which defines a window spanned by an array of blades; both parts have teeth enabling them to interfit to form a comb joint and the ends of the blades are imprisoned between adjacent teeth. In one version the two part molding is a sub-assembly which fits into a window in a preformed handle. In another version the handle has both window and teeth on two opposite edges of the window and a separate toothed molding is used to imprison the blades. ABS plastic and alloy are provided.

U.S. Pat. No. 4,507,804

Inventor: Claude Consigny

Issued: Apr. 2, 1985

A finger guard for protection against injury by a knife when cutting foodstuff. The finger guard extends along the back-hand face of an operator finger, and is bendable concurrently with the latter. The finger guard consists of a multiplicity of spaced-apart, interconnected lamellae, with a given upper lamella having a lower portion overlying the upper portion of the corresponding lower lamella; wherein should the blade of a knife hit the finger guard, that blade would subsequently slide downwardly successively from upper to lower lamellae in a frictionless fashion without injury to the finger. Two elongated flexible metal stems extends on each side of and pivotally interconnects with the lamellae. The stems can bend to follow the motion of the finger. An adjustable retaining strap surrounds the front hand face of the finger at an intermediate portion of the finger guard and a basket member, attached to the stems, receives the finger tip.

U.S. Pat. No. 5,626,067

Inventor: Arlan D. Lothe

Issued: May 6, 1997

A slicer guide suitable for use with a food item such as a loaf of bread, certain vegetables or the like is provided. The slicer guide includes a base having a generally planar upper surface. A flange is affixed to the base. The flange includes a top surface suitable for guiding a knife as it travels alongside the top surface, and a plurality of spaced-apart generally parallel grooves therein. A cutting board having a generally planar cutting surface suitable for abutting the product to be sliced thereon is adapted for slidable insertion into a selected groove. The slicer guide is used with the knife and the product to provide slices of thicknesses corresponding with the selected groove. The slicer guide is generally used for food items including bread and items such as cucumbers, tomatoes, peppers, mushrooms and the like.

U.S. Pat. No. 5,715,736

Inventor: Robert Cherney

Issued: Feb. 10, 1998

A hand held food holding device to secure articles of food for cutting or slicing which includes a base, a first wall, and a second wall. The first and second walls being connected to the base and extending upward therefrom to create a U-shaped member able to receive and secure articles of food while they are cut or sliced.

U.S. Pat. No. 5,927,701

Inventor: Dean Chapman

Issued: Jul. 27, 1999

A holder for containing items to be sliced is provided. The holder includes a base, a first sidewall having a proximal end fixedly secured to the base and a distal end, and a second sidewall having a proximal end fixedly secured to the base and a distal end. The sidewalls have a normal rest position wherein the distal ends are spaced apart a predetermined distance. At least one of the sidewalls is formed of a flexible and resilient material and is deflectable from the rest position in a direction which increases the distance between the distal ends.

While these food handling devices may be suitable for the purposes for which they were designed, they would not be as suitable for the purposes of the present invention, as hereinafter described.

SUMMARY OF THE PRESENT INVENTION

The present invention discloses a finger shield that is placed over elongated vegetables or like food items such as carrots or celery to provide an effective barrier between a cutting blade and the user's fingers when the person is slicing the foodstuff. The U-shaped body of the present invention is used to contain and control the food stuff and the handle is for ease of use as the user slides or lifts the device. The bottom edges of the present invention are placed against a planar cutting surface. The present invention may also include a compression means for stabilizing the object to be cut. The present invention has a spring-loaded handle member that passes through a handle recess in the body and is integral with a compression plate concentrically configured to reside flush against the upper portion of the inner wall of the U-shaped body when in the static position. A spring element housed in a spring housing exerts a bias that maintains the handle member in the elevated position until sufficient pressure is applied downwardly against the handle member to overcome the bias and lower the handle member and its associated compression plate until the compression plate contacts the foodstuff thereby effectively clamping the foodstuff between the compression plate and the cutting surface. The handle element returns to the elevated position as the user removes the applied pressure when sliding the present invention to the next cutting plane.

A primary object of the present invention is to provide a finger shield to prevent a person slicing vegetables from inadvertently cutting themselves.

Another object of the present invention is to provide a finger shield for slicing vegetables having a substantially semi-cylindrical body that is placed over the vegetables to be sliced.

Yet another object of the present invention is to provide a finger shield for slicing vegetables with a flange extending outward from one end of said body.

Still yet another object of the present invention is to provide a finger shield for slicing vegetables wherein the outer face of the finger shield defines the cutting plane.

Another object of the present invention is to provide a finger shield for slicing vegetables that the user slides into the desired position to reach the next cutting plane.

Yet another object of the present invention is to provide a finger shield for slicing vegetables overcomes the shortcomings of the prior art.

Another object of the present invention is to provide a finger shield for slicing vegetables that is simple and easy to use Still yet another object of the present invention is to provide a finger shield for slicing vegetables that is cost effective to manufacture.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
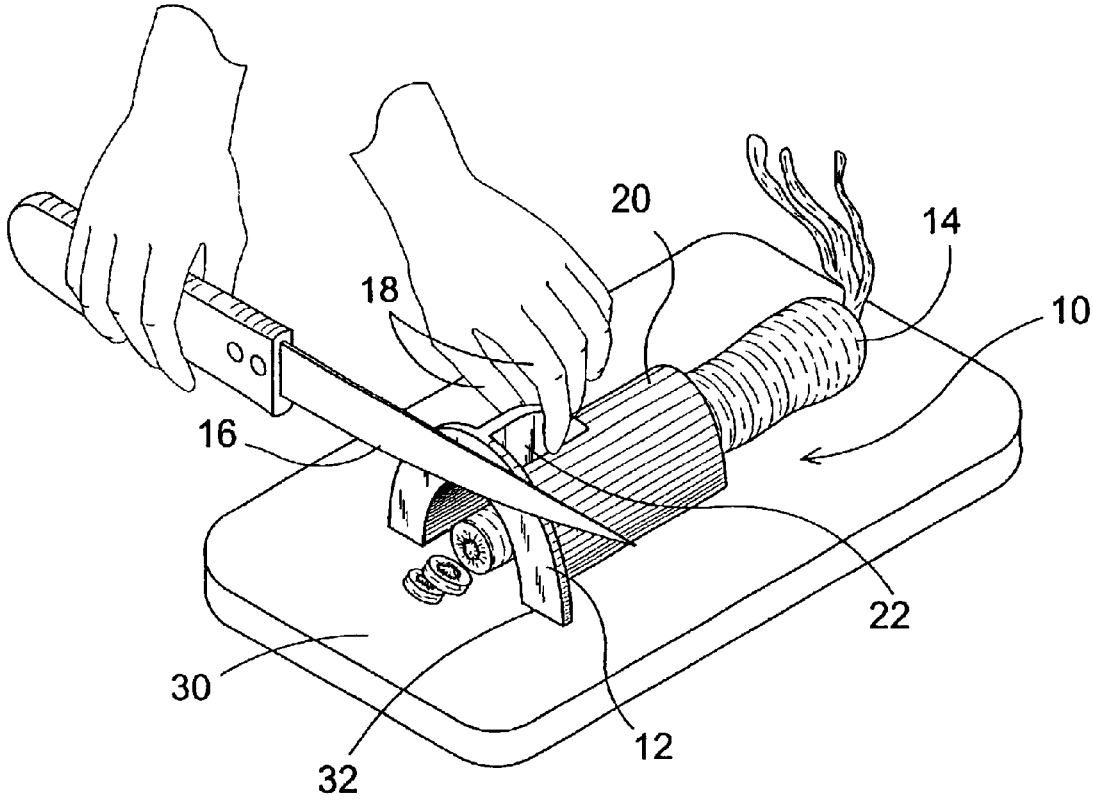
FIG. 1 is an illustrative view of the present invention in use.

With regard to reference numerals used, the following numbering is used throughout the drawings.

10 present invention
12 finger shield
14 food item
16 cutting blade
18 fingers
20 body
22 handle member
24 arrows
26 face of finger shield
28 concave portion
30 cutting surface
32 bottom edge
34 partial cavity
36 spring loaded handle
38 recess
40 compression plate
42 spring housing
44 flange
46 central aperture
48 retaining screw
50 spring
52 recess

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 provides a finger shield 12 that is placed over elongated vegetables or like food items 14, such as carrots or celery, to provide an effectively sized barrier between a cutting blade 16 and the user's fingers 18 when the user is slicing the foodstuff. The U-shaped body 20 of the present invention 10 is used to contain and control the food stuff 14 and the handle 22 is for ease of use as the user slides or lifts the device. Also shown is a planar cutting surface 30 upon which the bottom edges 32 of the present invention 10 are placed. The shield 12 extends laterally away from the outer surface of the body 20 to form a flange against which the cutting blade 16 reciprocates in a parallel manner. The body is elongated an effective length to keep the food item substantially perpendicular thereto so that the slices will be uniform in size and shape.

Figure 2:
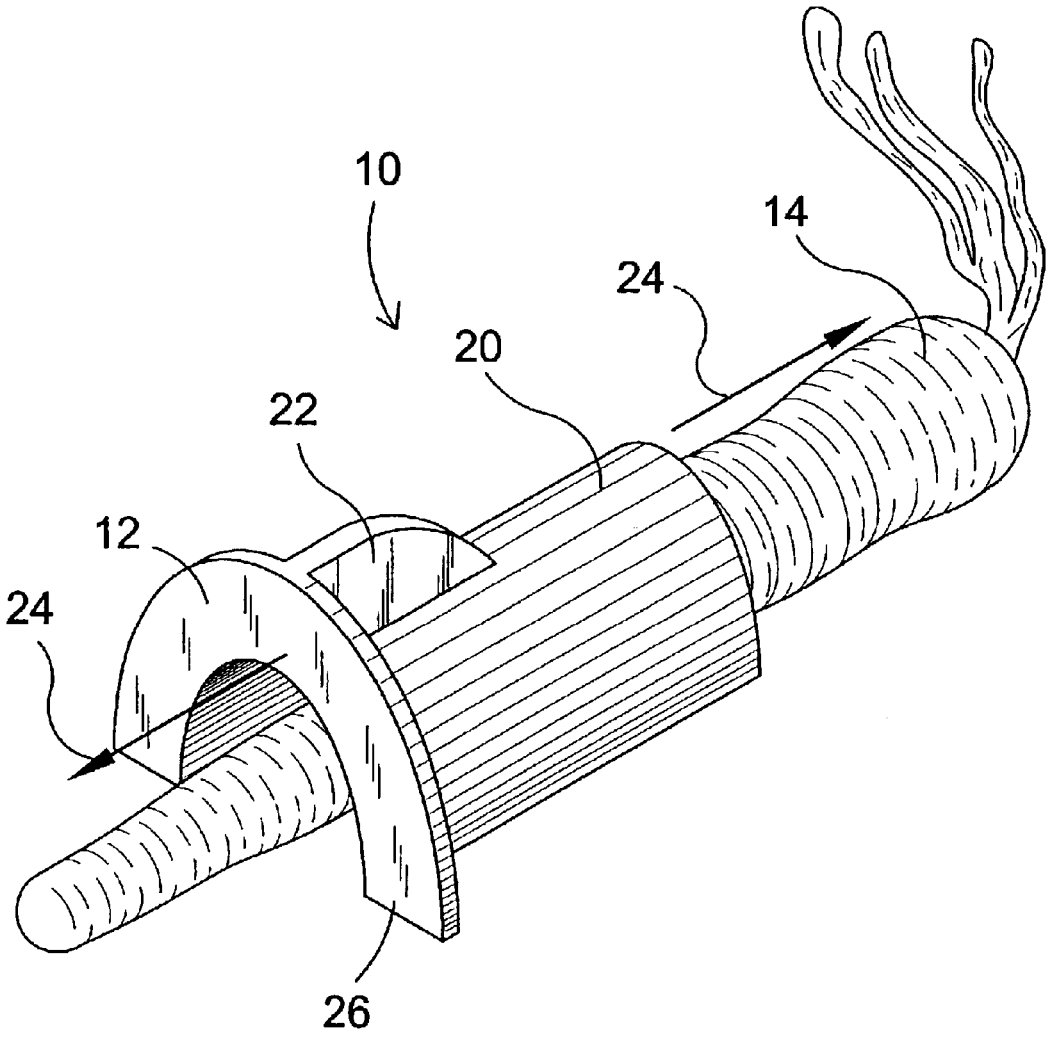
FIG. 2 is a perspective view of the present invention.

Turning to FIG. 2, shown therein is a perspective view of the present invention 10. The present invention 10 is shown placed over a carrot 14 that is now ready for slicing. The user holds and controls the present invention 10 by grasping the handle member 22 between the fingers which are expected to be the thumb and the forefinger. The body 20 is placed over the foodstuff to be sliced and slid longitudinally as shown by arrows 24 to align the face 26 of the finger shield 12 with the desired cutting plane. The cutting blade uses the finger shield 12 as a guide during the reciprocal slicing motion thereof. The user grasps the handle 22 when retaining the foodstuff within a restricted area and when sliding the finger shield 12 to the next cutting plane.

Figure 3:
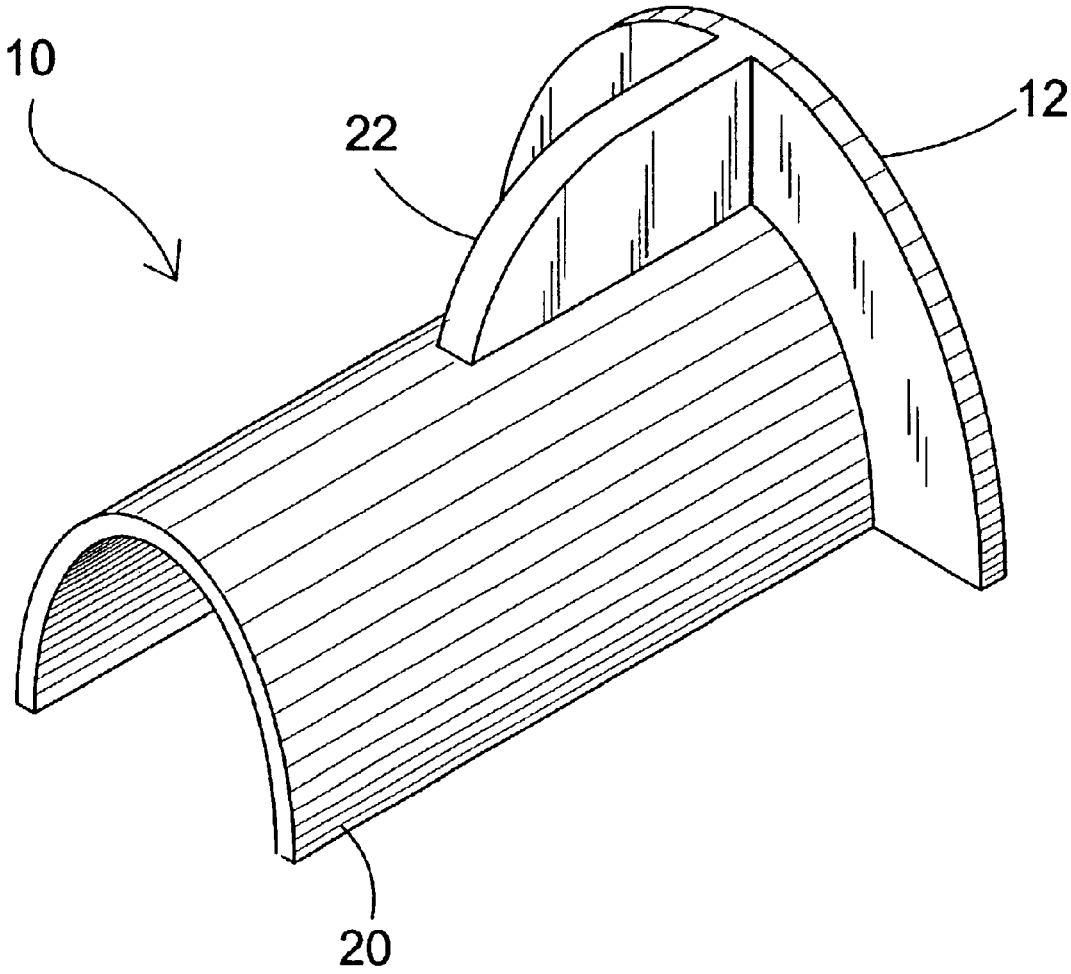
FIG. 3 is a rear perspective view of the present invention.

Turning to FIG. 3, shown therein is a rear perspective view of the present invention 10. Shown is a rear perspective view of the present invention 10 showing some of the elements previously disclosed including the finger shield 12, handle 22, and body 20.

Figure 4:
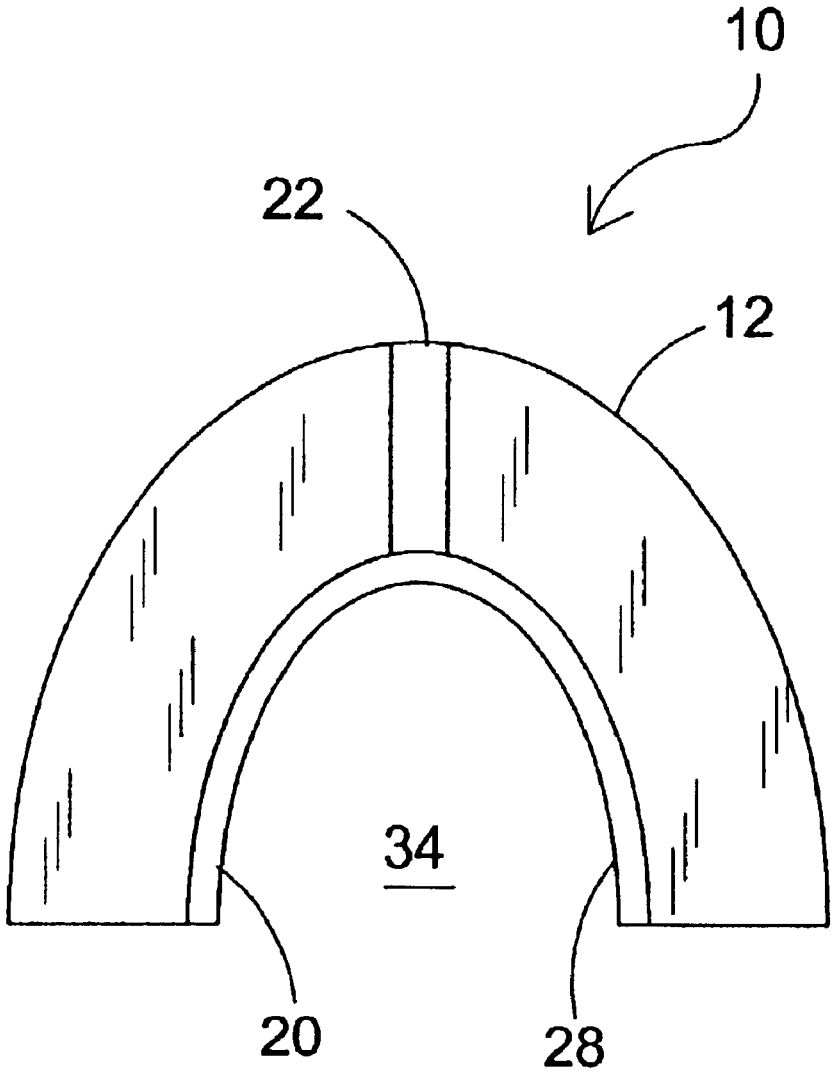
FIG. 4 is a rear view of the present invention.

Turning to FIG. 4, shown therein is a rear view of the present invention 10. Shown is a rear view of the present invention 10. The foodstuffs to be cut are retained within the downwardly concave portion 28 of the U-shaped or concave body 20 which forms a partial cavity or throughbore 34 between the body and the planar cutting surface to receive the foodstuffs therein. Also shown are the finger shield 12 and handle 22.

Figure 5:
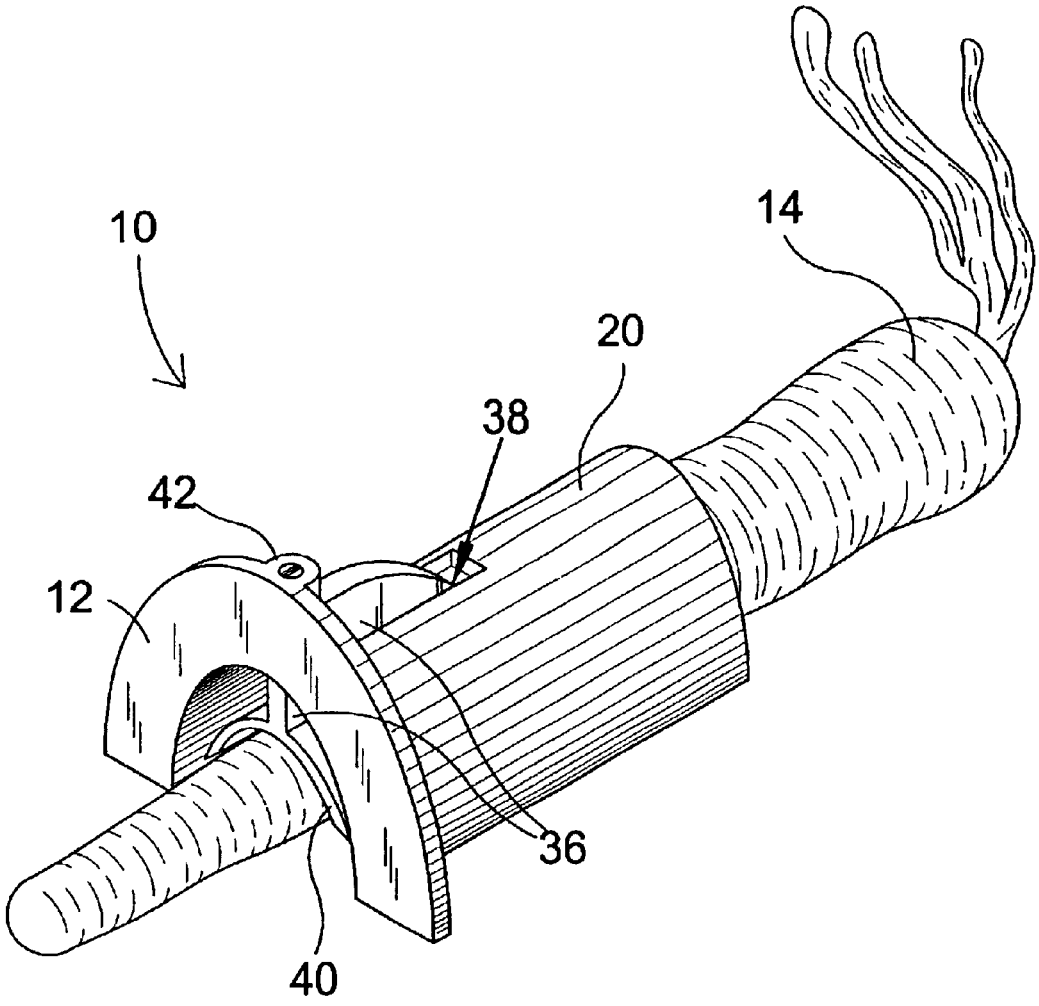
FIG. 5 is a perspective view of the present invention.

Turning to FIG. 5, shown therein is a perspective view of an alternate embodiment of the present invention 10 with finger shield 12. The present invention 10 may also include a compression means 40 for stabilizing the object to be cut. Shown is the present invention 10 having a spring-loaded handle member 36 that passes through a handle recess 38 disposed in the top of the body 20 and is integrally constructed with a compression plate 40 concentrically configured to reside flush against the upper portion of the inner wall of the U-shaped body 20 when in the static position. A spring element housed in a spring housing 42 exerts a bias that maintains the handle member 36 in the elevated position until sufficient pressure is applied downwardly against the handle member to overcome the bias and lower the handle member 36 and its associated compression plate 40 until the compression plate contacts the foodstuffs 14, i.e., a carrot, thereby effectively clamping the carrot between the compression plate and the cutting surface. The handle element 36 returns to the elevated position as the user removes the applied pressure when sliding the present invention 10 to the next cutting plane.

Figure 6:
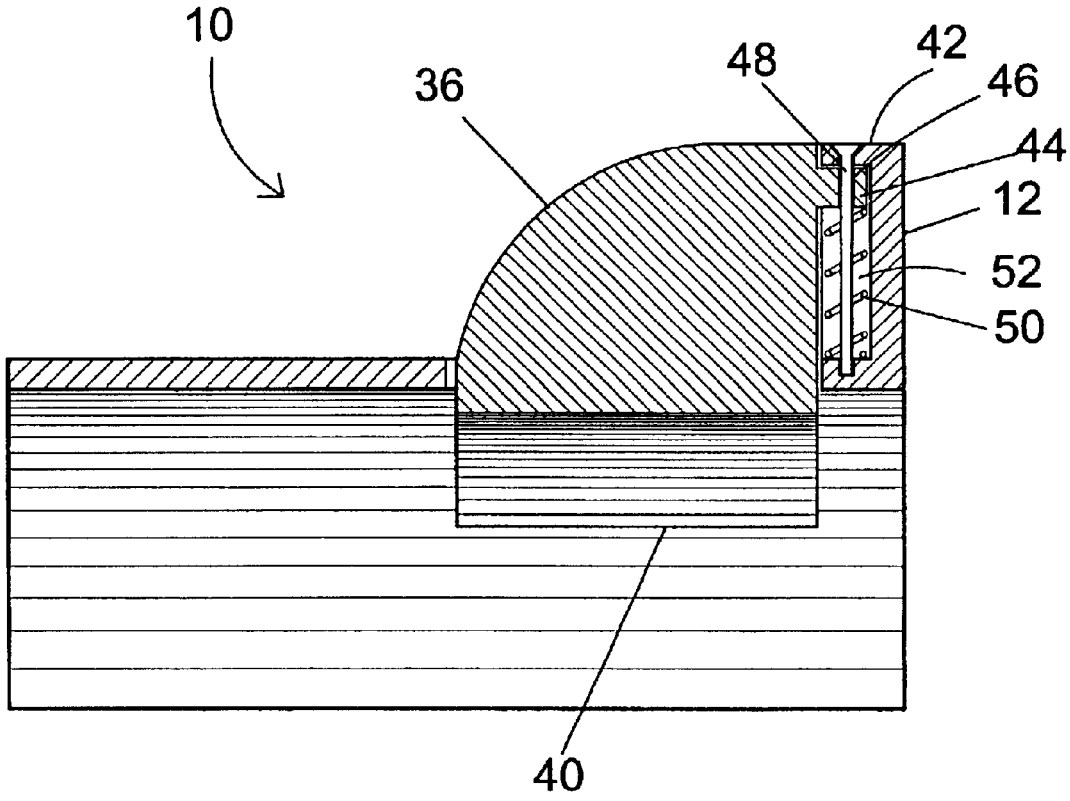
FIG. 6 is a cross sectional side view of an alternate embodiment of the present invention.

Turning to FIG. 6, shown therein is a cross sectional side view of an alternate embodiment of the present invention 10. Shown is the present invention 10 with the handle member 36 and compression plate 40 in the normal elevated position along with means for reciprocating the plate 40. The handle element 36 has a retaining flange 44 with a central aperture 46 wherein the flange extends forward into a spring housing 42 with a retaining screw 48 or other such shaft member passing downwardly through the aperture 46 of the flange 44 to function as an attachment means for the handle member 36 and to provide a guide during the vertical travel thereof. The spring housing has a recess 52 therein within which recess 52 the flange 44 and spring 40 reciprocate. The spring element 50 presents an upward bias to the retaining flange 44 of the handle member 36 to maintain it in the elevated position during normal conditions. Also shown is finger shield 12. Note that the plate extends downwardly about one-third the distance between the top of the cavity and the cutting surface to be able to accept various sizes of foodstuffs.

Figure 7:
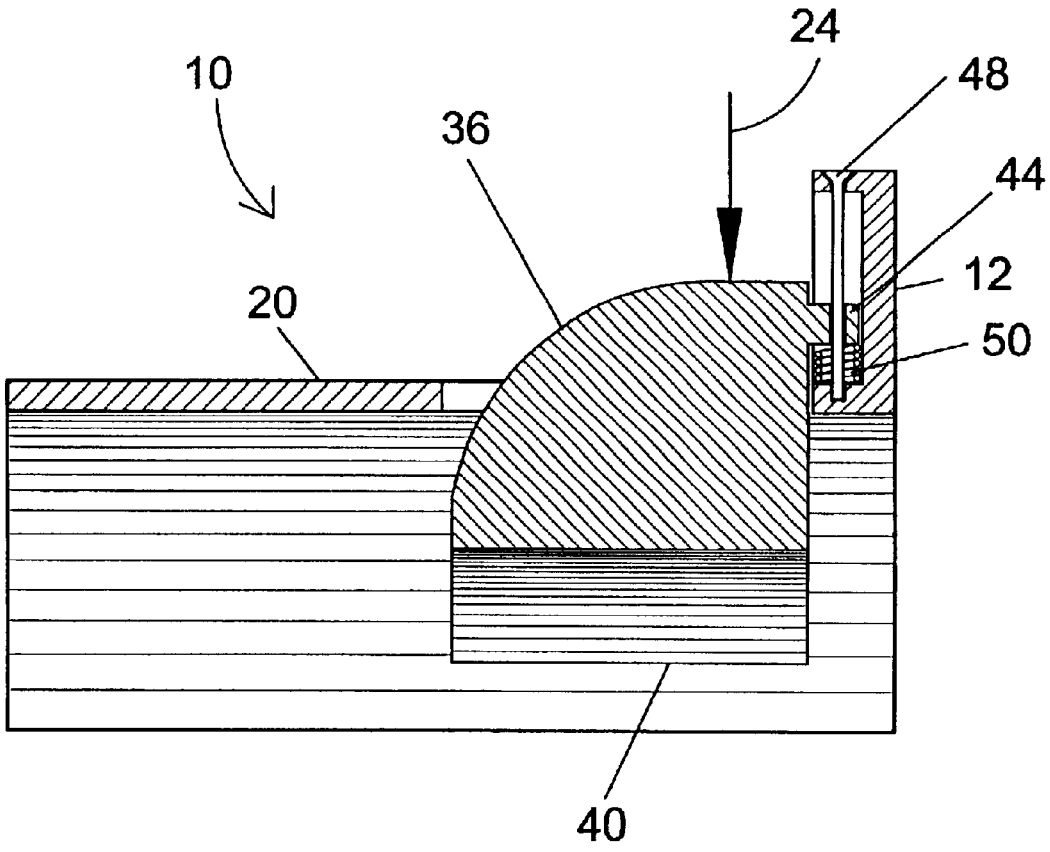
FIG. 7 is a cross sectional side view of an alternate embodiment of the present invention.

Turning to FIG. 7, shown therein is a cross sectional side view of an alternate embodiment of the present invention 10. Pressure applied to the handle member 36 by the user as shown by arrow 24 depresses the spring element 50 and allows the handle member 36 and its associated compression plate 40 to descend in order to clamp the foodstuff to be sliced against the cutting surface thereby reducing movement thereof during slicing. Shown are the body 20, retaining screw 48, retaining flange 33 and finger shield 12.

Figure 8:
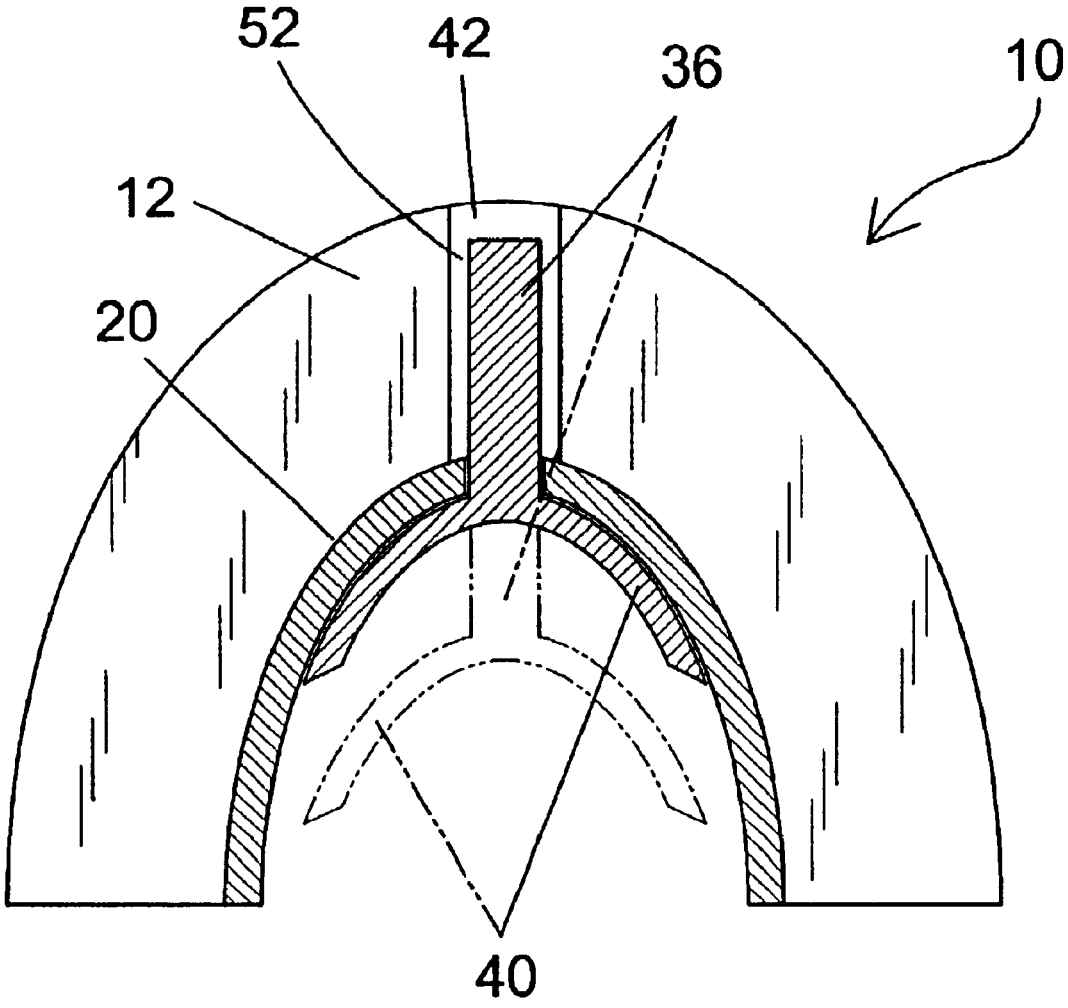
FIG. 8 is a rear cross sectional view of an alternate embodiment of the present invention.

Turning to FIG. 8, shown therein is cross sectional rear view of an alternate embodiment of the present invention 10. Shown are the spring-loaded handle member 36 and the related compression plate 40 in the elevated position with the depressed position depicted in phantom line. The compression element 40 of the present invention 10 permits the user to exercise greater control of the foodstuff to be cut during slicing and adapts to vegetables of various sizes. Shown are the body 20, finger shield 12, spring housing 42 and recess 52.

I claim:

1. A device for use by one who is slicing foodstuffs with a cutting blade on a planar cutting surface, comprising:

a) a concave body having first and second opposing ends, said body having a top and a bottom, wherein said concave body has an inner and outer surface, said concave body having a concave cavity therein, said concave cavity forming a throughbore therein wherein said throughbore is formed between said concave body and the planar cutting surface;

b) a foodstuff disposed in said throughbore to permit a user to slice it;

c) an enlarged finger shield disposed on said first end of said concave body, wherein said finger shield forms a flange extending laterally away from said outer surface of said concave body a distance effective to protect the fingers of a user from the cutting blade, said flange having a front face and a rear face, wherein the cutting blade reciprocates parallel to said front face as the foodstuff is sliced; and, d) a handle disposed on said top of said concave body to permit one to grasp the handle while the foodstuff is being sliced, said handle running longitudinally along said top of said concave body, wherein said handle joins said rear of said finger shield and said top of said concave body;

e) said concave body being elongated an effective length to retain a foodstuff in said throughbore so that the foodstuff is substantially perpendicular to the cutting blade to permit one to slice uniform sized pieces of the foodstuff, f) said handle having a front end and a rear end, wherein said front end joins said rear of said finger shield, wherein said handle extends longitudinally along said concave body toward said second end of said concave body; and g) means for compressing the foodstuff against the cutting surface whereby the foodstuff can be secured while the foodstuff is being sliced by the cutting blade.

2. The device of claim 1, wherein said means for compressing the foodstuff comprises:

a) a compression plate, said plate being complimentarily shaped as said inner surface of said concave body, said plate having a top, wherein said plate reciprocates vertically between a raised position and a lowered position, wherein said top of said plate resides adjacent to and concentric with said top of said inner surface of said concave body when said plate is in a raised position;

b) said top of said concave body having a first recess therein, wherein said first recess is elongated along said top of said concave body;

c) a handle disposed on said top or said plate, said handle having a top end, a bottom end, a front end and a rear end, wherein said handle is complimentarily sized as said first recess, wherein said handle extends vertically upward from said plate, wherein said bottom end of said handle is attached to said top of said plate and said top of said handle passes through said first recess; and, d) means for reciprocating said plate and said handle whereby the plate and handle reciprocate between a raised position and a lowered position.

3. The device of claim 2, wherein said compression plate extends downward about one-third the distance between said top of said inner surface of said concave body and the planar cutting surface to permit the compression plate to accept various sizes of foodstuffs.

4. The device of claim 3, wherein said means for reciprocating said plate and said handle comprise:

a) a forwardly extending flange disposed on said top forward end of said handle, said flange having an aperture therein, said aperture being oriented in the vertical direction;

b) wherein said rear face of said finger shield has a second recess therein, wherein said second recess is vertically disposed in said finger shield to receive said forwardly extending flange of said handle, said second recess having a top end and a bottom end;

c) an elongated screw extending vertically downwardly through said aperture on said flange of said handle from said top end to said bottom end of said second recess, wherein said threads of said screw are embedded in said bottom end of said second recess; and, d) a spring disposed around said screw, said spring having a first and second opposing and, wherein said first end contacts said forwardly extending flange of said handle and said second end contacts said bottom of said second recess, wherein said spring biases said flange of said handle upwardly away from said bottom of said second recess to permit the plate and the handle to reciprocate between a raised position and a lowered position.

* * * * *